US005689779A

United States Patent [19]

Miyamoto et al.

[11] Patent Number: 5,689,779

[45] Date of Patent: Nov. 18, 1997

[54] LIQUID DEVELOPER AND DEVELOPING METHOD AND DEVELOPING APPARATUS USING SAME

[75] Inventors: Hidetoshi Miyamoto, Takatsuki; Toshimitsu Fujiwara, Kobe; Shuji Iino, Muko, all of Japan

[73] Assignee: Minolta Co., Ltd., Osaka, Japan

[21] Appl. No.: 646,568

[22] Filed: May 8, 1996

[30] Foreign Application Priority Data

May 8, 1995 [JP] Japan ..... 7-109728

[51] Int. Cl.[6] ..... G03G 15/10; G03G 9/08

[52] U.S. Cl. ..... 399/237; 399/240; 399/241; 430/117; 430/119

[58] Field of Search ..... 355/256; 118/659, 118/661, 662; 430/32, 35, 114, 115, 116, 117, 119, 904; 523/160, 161; 399/237, 239, 240, 241, 249

[56] References Cited

U.S. PATENT DOCUMENTS

| | | | |
|---|---|---|---|
| 3,900,412 | 8/1975 | Kosel | 430/114 |
| 5,275,906 | 1/1994 | Materazzi | 430/115 X |
| 5,290,653 | 3/1994 | Pearlstine | 430/115 X |
| 5,407,771 | 4/1995 | Landa et al. | 430/115 X |
| 5,432,036 | 7/1995 | Beach et al. | 430/115 |
| 5,471,287 | 11/1995 | Blair et al. | 355/256 |
| 5,529,874 | 6/1996 | Kobayashi et al. | 430/116 |
| 5,554,476 | 9/1996 | Landa et al. | 430/115 X |
| 5,561,264 | 10/1996 | Iino et al. | 118/661 |
| 5,563,015 | 10/1996 | Bonsignore et al. | 430/115 X |

*Primary Examiner*—Mathew S. Smith

*Attorney, Agent, or Firm*—McDermott, Will & Emery

[57] ABSTRACT

A liquid developer for developing an electrostatic latent image having a carrier fluid and electrically charged toner particles dispersed therein, wherein the liquid developer satisfies the following relationship:

$$25.0 \geqq V_0/\Delta V_{10} \geqq 1.5$$

wherein $V_0$ denotes surface potential of a toner particle layer electrically deposited on a conductive substrate by applying bias voltage between the substrate and an electrode confronting with the substrate, and $\Delta V_{10}$ denotes change of the surface potential decaying for 10 seconds after shutting off the bias voltage.

16 Claims, 4 Drawing Sheets

LIQUID DEVELOPER AND DEVELOPING METHOD AND DEVELOPING APPARATUS USING SAME

BACKGROUND OF THE INVENTION

1. Field of the Invention

This invention relates to a liquid developer to be used for developing an electrostatic latent image. It also relates to a developing method using the liquid developer. It further relates to a developing apparatus using the liquid developer.

2. Description of the Related Art

The electrophotography, which is an image forming process for developing an electrostatic latent image formed on a latent image carrying member such as the photosensitive member by electrically charged toner particles, is broadly classified under a dry developing method which directly uses a powdery toner and a liquid developing method which uses a liquid developer having a toner dispersed in carrier fluid.

The wet developing method implements the development of an electrostatic latent image on the surface of the photosensitive member by causing the liquid developer to contact the surface of the photosensitive member. Generally, the liquid developing method is more advantageous in terms of improvement of image quality than the dry developing method because it uses a toner having a smaller particle diameter than that of the toner used by the dry developing method.

As one version of the liquid developing method, the present inventors have made various studies on the liquid developing method which comprises temporarily electrodepositing toner particles on a developer carrying member by application of bias and then developing a latent image on a latent image carrying member with the electrodeposited toner particles.

As a result of these studies, the inventors have been ascertained that in the developing method of the type using such electrodeposited toner particles as mentioned above, the electrical charging property of the toner has a pronounced effect on the developing properties such as swaying the evenness of toner density in the developing area between the developing carrying member and the latent image member. In order for the temporarily electrodeposited toner to be effectively transferred to a given surface, it is considered necessary that even after the toner has been electrodeposited, the electric charging of the toner itself be retained to a certain extent. The speed of electrodeposition of the toner to the developer carrying member and the excess ion density in the developing liquid are also considered to have a profound effect on the developing properties. It has been ascertained that the developing method mentioned above requires a liquid developer which has the charging property and the excess ion density of toner adjusted so as to suit the developing method and that, if this developing method adopts the conventional popular liquid developer having an electric charge controlling agent incorporated in a large amount therein and exhibiting a large excess ion density, it will fail to acquire preferable developing properties or produce satisfactory results particularly in terms of high-speed development.

SUMMARY OF THE INVENTION

An object of this invention is to provide a novel and useful liquid developer which is liberated from the problems mentioned above.

Another object of this invention is to provide a liquid developer which possesses highly favorable developing properties.

Still another object of this invention is to provide a liquid developer which permits production of an image at an amply high density.

Yet another object of this invention is to provide a liquid developer which suits high-speed development.

Another object of this invention is to provide a liquid developer which enables the toner particles thereof to undergo electric charging highly satisfactorily.

Another object of this invention is to provide a liquid developer which manifests a high speed of electrodeposition of the toner on the developer carrying member.

Another object of this invention is to provide a liquid developer which has a small excess ion density.

Another object of this invention is to provide a novel and useful developing method and developing apparatus.

Another object of this invention is to provide a developing method and developing apparatus which is adapted for augmentation of image quality.

Another object of this invention is to provide a developing method and developing apparatus which is adapted for high-speed development.

Another object of this invention is to provide a developing method and developing apparatus which enables the toner density to be retained uniformly in the developing area.

For the purpose of accomplishing the objects mentioned above, it is necessary that the physical properties of the toner layer electrodeposited on the developer carrying member be profitable to the developing method mentioned above. To be specific, this invention concerns a liquid developer which comprises toner particles dispersed in a carrier liquid, which toner particles comprise a coloring agent dispersed in a binder resin, and which is characterized by satisfying the relation of the following formula (1):

$$25.0 \geqq V_0/\Delta V_{10} \geqq 1.5 \quad (1)$$

wherein $V_0$ stands for the surface potential of a layer of the toner particles electrodeposited on the surface of a conductive substrate by applying bias voltage between the conductive substrate and an electrode confronting the substrate, and $\Delta V_{10}$ for the change of the surface potential attenuating from the $V_0$ over a period of 10 seconds following the termination of the bias application.

The present invention also concerns a liquid developer comprising a carrier fluid, electrically charged toner particles dispersed therein, and an effective amount of desorbed ions for development of electrostatic latent image by toner particles electrodeposited on a developer carrying member.

BRIEF DESCRIPTION OF THE DRAWINGS

In the following drawings, like parts are denoted by like reference numerals.

DESCRIPTION OF THE PREFERRED EMBODIMENTS

Figure 1:
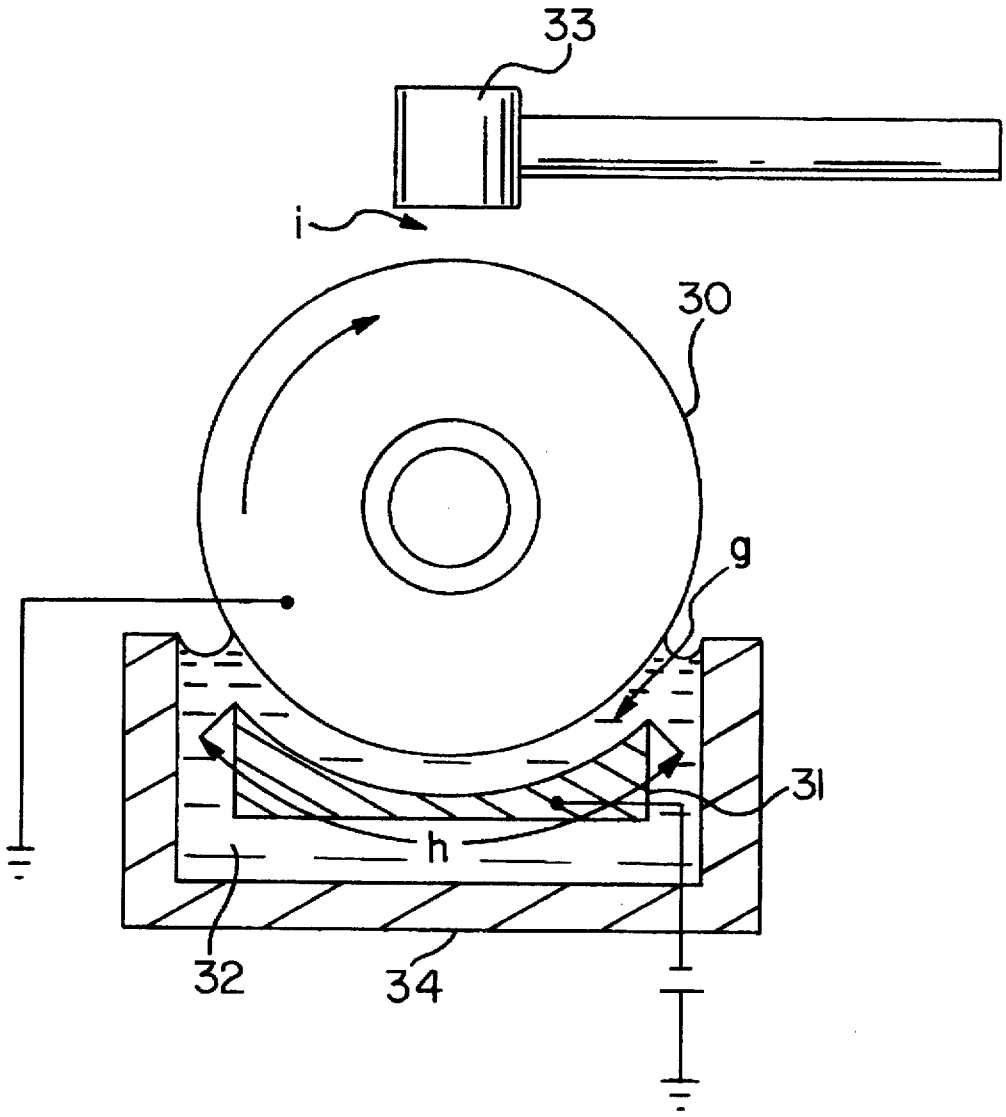
FIG. 1 is a schematic diagram of an evaluating device to be used for rating physical properties of a liquid developer.

The liquid developer which constitutes itself a preferred embodiment of this invention includes toner particles dispersed in a liquid carrier, which toner particles having at least a coloring agent such as a pigment or a dye dispersed in a binding resin. It may incorporate therein, when necessary, well-known charge controlling agent, dispersing resin, and other additives in suitable amounts as will be described herein below.

The liquid developer desirably satisfies the relation:

$$25.0 \geqq V_0/\Delta V_{10} \geqq 1.5$$

and preferably the relation:

$$20.0 \geqq V_0/\Delta V_{10} \geqq 1.5$$

wherein $V_0$ stands for the surface potential of a layer of toner particles electrodeposited on the surface of a conductive substrate by applying bias voltage between the conductive substrate and an electrode confronting the substrate, and $\Delta V_{10}$ for the change of the surface potential attenuating from the $V_0$ over a period of 10 seconds following the termination of the bias application.

The surface potential, $V_0$, of the electrodeposited toner layer represents the apparent charging property of the toner and relates mainly to the true magnitude of charging of the toner and the ion density in the liquid developer. The surface potential, $V_0$, of the electrodeposited toner layer tends to increase in proportion as the magnitude of charging of the toner increases and the ion density in the liquid developer increases. Although it is only natural that the surface potential of the electrodeposited toner layer should be observed to be high when the magnitude of charging of the toner itself is large, the logical interpretation of this trend is that the surface potential of the electrodeposited toner layer rises because the ions of the same polarity as the toner which exist in the liquid developer pour onto the electrodeposited toner layer. It is, therefore, unsafe to conclude that the magnitude of charging of the toner is large when the surface potential of the electrodeposited toner layer is large.

The magnitude of the attenuation of the surface potential of the electrodeposited toner layer which is followed by the termination of the bias application for electrodeposition mainly relates to on the volume resistivity of the electrodeposited toner layer and the ion density in the liquid developer. The absolute magnitude of the attenuation of the surface potential of the electrodeposited toner layer tends to increase in proportion as the volume resistivity of the electrodeposited toner layer decreases and the ion density in the liquid developer increases.

The fact that the absolute magnitude of the attenuation of the surface potential of the electrodeposited toner layer increases in proportion as the ion density in the liquid developer increases implies that the amount of excess ions that have escaped being adsorbed on the toner surface is large. Accordingly, the amount of ions of the same polarity as the toner which pour down onto the electrodeposited toner layer proportionately increases, therefore, the amount of ions eliminated from the electrodeposited toner layer after the termination of the bias application and the absolute magnitude of the attenuation of potential due to neutralization of ions on the surface of the developer carrying member proportionately increase. Further, the amount of charge inherently owned by the toner tends to decrease when the volume resistivity of the electrodeposited toner layer is low.

The amount of ions incorporated in the developed image on the latent image carrying member increases in proportion as the amount of excess ions in the liquid developer increases or the ion density in the liquid developer increases. As a result, the potential of the latent image tends to decline and the amount of development of the toner declines as well. Thus, the developing properties tend to be degraded to an extent such that an ample image density may no longer be obtained.

The present inventors, after taking particular notice of the properties of the toner layer electrodeposited on the developer carrying member among other factors regarding the process which comprises electrodepositing the toner on the developer carrying member and then developing the latent image on the latent image carrying member by the electrodeposited toner, have pursued various studies to find out that the ratio of the surface potential of the electrodeposited toner layer on the bias application to the decrement in the surface potential of the electrodeposited toner layer after the termination of the bias application for electrodeposition governs the developing properties to a great extent. The significance of the control of these physical properties has been consequently confirmed.

Specifically, a correlation evidently exists between the value of the ratio ($V_0/\Delta V_{10}$) of the surface potential, $V_0$, of the toner layer electrodeposited on the surface of the developer carrying member mentioned above in the presence of bias application to the decrement in the surface potential of the electrodeposited toner layer, $\Delta V_{10}$, attenuating from $V_0$ over a period of 10 seconds following the termination of the bias application and the developing properties. If the value of $V_0/\Delta V_{10}$ is unduly small, the developing properties may be degraded, the speed of electrodeposition of the toner on the developer carrier may be lowered, and the toner density in the developing area will tend to be deprived of evenness. If the value of $V_0/\Delta V_{10}$ is unduly large, the problem may ensue that the toner deposited on the developer carrying member is transferred only with difficulty to such a transfer medium as paper or intermediate transfer member. The value of $V_0/\Delta V_{10}$, therefore, is preferably to be controlled advantageously at such a proper level as mentioned above.

The volume resistivity of the liquid developer is required to be not less than $10^{10}$ Ω·cm, preferably not less than $10^{12}$ Ω·cm. By setting the volume resistivity of the liquid developer at a level of $10^{10}$ Ω·cm or more, the resistance of the liquid developer can be optimized and the occurrence of such defects as flow of image can be minimized.

The carrier liquid is not discriminated on account of the kind of substance so long as it has such resistivity as avoids disturbing the electrostatic latent image formed on the latent image carrying member such as photosensitive member or the like. It is, however, preferred to be a solvent which is substantially free from offensive odor and toxicity and has a relatively high flash point. Appropriately if not particularly restrainingly, it possesses volume resistivity in the approximate range of $10^{10}$~$10^{14}$ Ω·cm. As typical examples of the carrier liquid which fulfills the condition, such liquids of high insulating property and low dielectric property as IP solvent series (Idemitsu Petro-Chemical Co., Ltd.) and Isopar series (Esso Oil) which are isoparaffin type hydrocarbon solvents may be cited.

Absolutely no limit is imposed on the method to be adopted for producing minute colored particles (toner) which are used for the liquid developer. As typical examples of the various known methods which are available for the production, (1) a method which consists in coloring minute resin binder particles with a colorant and (2) a method which comprises melting and kneading a colorant and a resin binder thereby preparing a colored resin and pulverizing the colored resin by a varying pulverizing method thereby obtaining minute colored particles (toner) may be cited. The method of (1) mentioned above will be specifically described below. It is known in several types, including a method which comprises obtaining minute resin particles by the suspension polymerization technique, emulsion polymerization technique, non-water dispersion polymerization technique, seed polymerization technique, emulsion dispersion granulating technique, spray drying technique, dry pulverizing technique, or in-solvent griding technique and applying a pigment fast to the surface of the minute resin particles and a method which consists in dyeing resin particles with a dye in a solvent which is substantially incapable of dissolving the resin particles and capable of dissolving the dye. As typical examples of the device which is adopted for the fast application of the pigment to the surface of minute resin particles, Hybridization System (produced by Nara Kikai Seisakusho K.K.), Angmil (produced by Hosokawa Micron K.K. ), and Dispercoat (produced by Nisshin Engineering K.K.) may be cited. The method of (2) mentioned above will be specifically described. It is known in several types, including a method which comprises preparing a colored resin by melting and kneading a colorant and a resin binder, then primary crushing the colored resin to a particle diameter of about 1 mm, and further finely pulverizing the coarse resin particles by the use of a dry finely pulverizing device such as the jet mill or an alternative method which comprises converting coarse resin particles into fine resin particles in a solvent destined to serve as a carrier liquid in a device such as a wet media mill. As concrete examples of the dry pulverizing device, Jet Mill (produced by Japan Pneumatic Kogyo K.K.) and Cryptton Pulverizer (produced by Kawasaki Jukogyo Kabushiki Kaisha) may be cited. As typical examples of the wet media mill, Mitsubishi UF Mill (produced by Mitsubishi Heavy Industries, Ltd.), Aiger Motor Mill (produced by Aiger Japan K.K.), Ultra Viscomill (produced by Aimex K.K.), and Spikemill (produced by Inoue Seisakusho K.K. ) may be cited. In the liquid developers that use toner particles obtained by these toner production methods, the liquid developers using toner particles obtained by the method of toner production of (2) which do not easily manifest a difference in the amount of charging due to the kind of colorant prove preferable and those which result from wet pulverization using the media mill in an isoparaffin type solvent destined to serve as the carrier liquid prove still more preferable.

Appropriately the minute colored particles (toner) has a particle diameter such that the volume average particle diameter falls in the range of 0.5~5.0 μm preferably in the range of 1.0~4.0 μm. If the particle diameter of the toner is less than 0.5 μm, the mobility of the toner particles may be unduly small and the speed of development may be consequently lowered and, in the range of system speed exceeding a certain level, the image density may be inevitably lowered. Conversely, if the particle diameter of the toner exceeds 5.0 μm, the resolution may be inevitably degraded. The speed of development and the density of image can be both satisfied by controlling the volume average particle diameter of the toner in the range of 0.5~5.0 μm. The volume average particle diameter and the size distribution of the toner may be measured by the use of an instrument made by Shimadzu Seisakusho Ltd., and designated as "SALD-1100" for example.

As the binding resin for the toner, the various kinds of resins which are popularly used as binding resins in ordinary toners are generally usable appropriately. As concrete examples of these resins, thermoplastic resins such as styrene type resins, (meth)acryl type resins, olefin type resins, polyester type resins, amide type resins, carbonate resins, polyethers, and polysulfones, oligomers or prepolymers of such thermoplastic resins as epoxy resin, urea resin, and urethane resin, and copolymers of monomers for such various type resins, and polymer blends thereof may be cited. These resins embrace not only those which are in the form of perfect polymers such as those of thermoplastic resins but also those which are in the form of oligomers or prepolymers such as those of thermosetting resins and further those which have a prepolymer, a cross-linking agent, etc. contained partly in polymers. These resins may be used either singly or in the form of a blend of two or more members. For the purpose of imparting ample charging property to the toner particles using such a resin binder and decreasing the excess ion density in the liquid developer, it is necessary that the adsorbing property of ions in the liquid developer to the surface of the toner should be improved. For the sake of this improvement, the resin binder is selected with the rule that it should possess a part permitting easy adsorption of ions. As concrete examples of the means to accomplish the improvement, a method which resorts to increasing the acid number of resin binder, a method which relies on blending the resin binder with other polar group-containing polymer or polar group-containing compound, and a method which depends on enhancing the ion adsorbing property of the toner particles by improving the surface of the toner particles may be cited.

When the resin binder is a styrene-acryl type resin, the increase of the acid number thereof is accomplished by causing the resin binder to copolymerize with an acidic monomer like (meth)acrylic acid as a comonomer. When the resin binder is a polyester type resin, the acid number thereof can be controlled by graft polymerizing a small amount of an acidic monomer thereto with the grafting ratio suitably controlled.

Generally, the acid number of the resin binder is properly in the range of 5~100 mg KOH/g. The acid numbers of resin binder which are indicated in this specification are those which have been determined as follows.

Five (5) g of a sample resin is dissolved in 50 ml of neutral solvent toluene-ethanol (2/1) and then the resultant solution is titrated with a KOH 0.04M ethanol solution. In the titration, phenol phthalein is used as an indicator.

$$\text{Acid number}=(a-b)\times f\times 2.244/w$$

wherein a stands for the end point of light red color (ml), b for the titre of a blank test (ml), f for the potency of the KOH 0.04M ethanol solution, and w for the amount of the sample resin (g).

As concrete examples of the other polar group-containing compound to be blended with the resin binder, organic acids such as carboxylic acids, sulfonic acids, and phosphoric acid, higher fatty acids, minute inorganic oxide particles such as minute silica particles, resin acids such as rosin, and derivatives thereof may be cited.

As a concrete example of the means for exalting the ion adsorbing property of the toner particles by improving the surface thereof, a method which comprises causing such a fine inorganic oxide powder as fine silica powder to be applied fast to the surface of toner particles may be cited. As concrete examples of the device which is usable for the fast application of such a fine inorganic oxide powder to the surface of toner particles, Hybridization System (produced by Nara Kikai Seisakusho K.K.), Angmil (produced by Hosokawa Micron K.K.), and Dispercoat (produced by Nisshin Engineering K.K.) may be cited.

The colorant to be used for the liquid developer appropriately is any of well-known organic dyes, organic pigments, and inorganic pigments (including carbon black) which come in varying colors. Particularly, C. I. Pigment Blue 15-3 (produced by Toyo Ink Mfg. Co., Ltd.), C. I. Pigment Yellow 17 (produced by Toyo Ink Mfg. Co., Ltd.), C. I. Pigment Red 122 (produced by Dai-Nippon Ink & Chemicals, Inc.), Mogul L (produced by Cabot Co., Ltd.), etc. are advantageously used. The colorant is generally used in an amount of 3~30 parts by weight, preferably 5~20 parts by weight, based on 100 parts by weight of the resin binder. If the amount of the coloring agent exceeds 30 parts by weight, the fixing property of the toner may be unduly low. Conversely, if it is smaller than 3 parts by weight, the possibility arises that necessary image density may not be obtained.

The dispersing resin to be added, as occasion demands, to the liquid developer may be any of the polymers that are soluble in the carrier liquid and need not be particularly limited. Concrete examples of the soluble dispersing resin are shown below.

1) Polymers or copolymers having nitrogen-containing monomers as components and exhibiting solubility to the carrier liquid:

A. (Meth)acrylates having aliphatic amino groups:

N,N-dimethyl aminoethyl (meth) acrylates, N,N-diethyl amino-ethyl (meth) acrylates, N,N-dibutyl aminoethyl (meth)acrylates, N,N-hydroxyethyl aminoethyl (meth) acrylates, N-benzyl-N-ethyl aminoethyl (meth)acrylates, N,N-dibenzyl aminoethyl (meth)-acrylates, N-octyl-N-aminoethyl (meth)acrylates, and N,N-dihexyl aminoethyl (meth)acrylates.

B. Nitrogen-containing heterocyclic vinyl monomers:

N-vinyl imidazole, N-vinyl indazole, N-vinyl tetrazole, 4-vinyl pyridine, 2-vinyl pyridine, 2-vinyl quinoline, 4-vinyl quinoline, 2-vinyl pyraridine, 2-vinyl benzoxazole, and 2-vinyl oxazole.

C. N-vinyl substituted cyclic amide monomers:

N-vinyl-2-pyrrolidone, N-vinyl piperidone, and N-vinyl oxazolidone.

D. (Meth)acrylamides:

N-methyl acrylamide, N-octyl acrylamide, N-phenylmethyl acrylamide, N-cyclohexyl acrylamide, N-phenylethyl acrylamide, N-α-naphthyl acrylamide, N-phenyl acrylamide, N-p-methoxyphenyl acrylamide, acrylamide, N,N-dimethyl acrylamide, N,N-dibutyl acrylamide, N-methyl-N-phenyl acrylamide, acryl piperidine, acryl morpholine, and methacrylamides corresponding thereto.

E. Aromatic substituted ethylenic monomers having nitrogen-containing groups:

Dimethyl aminos tyrene, diethyl aminos tyrene, diethyl amino-methyl styrene, and dioctyl aminostyrene.

F. Nitrogen-containing vinyl ether monomers:

Vinyl-N-ethyl-N-phenyl aminoethyl ether, vinyl-N-butyl-N-phenyl aminoethyl ether, triethanol amine divinyl ether, vinyl diphenyl aminoethyl ether, vinyl pyrrolidyl aminoether, vinyl-β-morpholinoethyl ether, N-vinyl hydroxyethyl benzamide, and m-aminophenyl vinyl ether.

The polymers which are formed of these monomers generally exhibit poor solubility to (iso)paraffinic hydrocarbon solvents. When an (iso) paraffinic hydrocarbon solvent is used as the carrier liquid, therefore, they are preferably used after being copolymerized with other monomer and consequently rendered soluble in the (iso)paraffinic carrier liquid.

As concrete examples of the other monomer which is used for the purpose of this copolymerization, hexyl (meth) acrylates, cyclohexyl (meth)acrylates, 2-ethylhexyl (meth) acrylates, octyl (meth)acrylates, nonyl (meth)acrylates, decyl (meth)acrylates, dodecyl (meth)acrylates, lauryl (meth)acrylates, stearyl (meth)-acrylates, vinyl laurate, vinyl stearate, benzyl (meth) acrylates, phenyl (meth) acrylates, styrene, and vinyl toluene may be cited.

These nitrogen atom-containing polymers are advantageous because they are highly effective in exalting the charging property of the toner and curbing the occurrence of excess ions in the liquid developer. Among other nitrogen atom-containing polymers mentioned above, N-vinyl pyrrolidone or random or graft copolymers of dimethyl aminoethyl methacrylate with a methacrylic ester having an alkyl group of 10~20 carbon atoms may be cited as particularly advantageous examples.

Other concrete examples of the soluble dispersing resin are as follows.

2) Polymers of acryl monomers having long-chain alkyl groups such as 2-ethylhexyl (meth)acrylates, lauryl (meth) acrylates, and stearyl (meth)acrylates and copolymers (random copolymers, graft copolymers, and block copolymers) of such polymers with other monomers [styrene, (meth)acrylic acid, and methyl, ethyl, and propyl esters thereof], and 3) Rosin and rosin-modified resins.

When such a dispersing resin is added as occasion demands, the amount of the resin to be added is properly in the range of 1~10% by weight, preferably in the range of 2~5% by weight, based on the amount of the toner particles.

The liquid developer, when necessary, may have any of the well-known charge controlling agents incorporated therein in a suitable amount.

As concrete examples of the charge controlling agent, metal salts of such fatty acids as naphthenic acid, octenoic acid, oleic acid, and stearic acid, metal salts of sulfosuccinic esters, metal salts of phosphoric esters, metal salts of abletic acid or hydrogenated abietic acid, calcium alkylbenzenesulfonates, metal salts of aromatic carboxylic acids or sulfonic acids, nonionic surfactants such as polyoxyethylated alkylamines, oils and fats such as lecithin and linseed oil, organic acid esters of polyhydric alcohols, phosphoric ester type surfactants, and sulfonic acid resins may be cited.

When liquid developers of different colors are used as when a full-color image is formed by overlaying four color images produced by development using four colors of yellow, magenta, cyan and black, the development can be performed excellently by coordinating the numerical value of the ratios, $V_0/\Delta V_{10}$, of the liquid developers of different colors.

The ratio of the total weight of such solid components as the toner and the dispersant to the total weight of the liquid developer (ratio of solids) is appropriately in the range of 1~90% by weight. Particularly from the viewpoint of decreasing the total amount of the liquid developer to be used for the development and facilitating the handling of the developer, the ratio of solids is appropriately in the range of 2~50% by weight.

Now, a typical experiment will be described. Wherever the word "parts" is mentioned, it invariably refers to "parts by weight."

<Production of disperse charge resin A>

A solution having 95 parts of lauryl methacrylate monomer dissolved in 200 parts of IP Solvent 1620 (produced by Idemitsu Petro-Chemical Co., Ltd.) was prepared. Argon gas was blown into the resultant solution for 10 minutes to displace the entire reaction system with argon gas. Then, the reaction system, after adding 1 mol %, based on the monomer, of benzoyl peroxide (BPO) as a polymerization initiator, was kept at 80° C. for four hours to polymerize the monomer. Subsequently, the reaction system, after being cooled to 30° C., allowed to add 5 parts of N-vinyl-2-pyrrolidone monomer and further add 1 mol %, based on the monomer, of azobis-isobutyronitrile (AIBN), was again kept at 90° C. for four hours to complete the polymerization. The solution of the lauryl methacrylate/N-vinyl-2-pyrrolidone copolymer consequently obtained was labeled as "disperse charge resin A."

<EXAMPLE 1>

In a Henschel mixer, 100 parts of a low molecular polyester resin (acid number: 15.0 mg KOH/g, Mn=2700, Mw=8500) and 20 parts of carbon black (produced by Cabot co. and marketed under trademark designation of "Mogul L") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

A mixture consisting of 30 parts of the coarse colored particles mentioned above, 1 part of the disperse charge resin A mentioned above, and 100 parts of IP Solvent 1620 (produced by Idemitsu Petro-Chemical Co., Ltd.) was pulverized and dispersed preparatorily with a sand mill using soda glass heads 2.0 mm in diameter as a medium under the conditions of two hours and 5000 rpm. It was subsequently in-solution grinded and dispersed with the same sand mill using soda glass heads 1.0 mm in diameter under the conditions of four hours and 5000 rpm to obtain a dense developing liquid of a very high toner concentration.

The dense developing liquid thus obtained, after adding 900 parts of IP Solvent 1620 and further 0.1 part of calcium dioctyl sulfonate, was thoroughly stirred and dispersed with a homomixer (produced by Tokushu Kika Kogyo K.K.) to obtain a liquid developer A. The volume average particle diameter of the toner (measured by a laser diffraction size distribution tester (produced by Shimadzu Seisakusho Ltd. and marketed under product code of "SALD-1100")) was 1.7 μm.

<CONTROL 1>

In a Henschel mixer, 100 parts of a low molecular polyester resin (acid number: 0.5 mgKOH/g, Mn=3000, Mw=9000) and 20 parts of carbon black (produced by Cabot Co. and marketed under trademark designation of "Mogul L") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer B. The volume average particle diameter of this liquid developer measured with the same device as in Example 1 was 1.8 μm.

<CONTROL 2>

In a Henschel mixer, 100 parts of a low molecular polyester resin (acid number: 35.0 mgKOH/g, Mn=2700, Mw=8500) and 20 parts of carbon black (produced by Cabot Co. and marketed under trademark designation of "Mogul L") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a dense developing liquid of a very high toner concentration.

The dense developing liquid thus obtained, after adding 900 parts of IP Solvent 1620 and further 5.0 parts of calcium dioctyl sulfonate, was thoroughly stirred and dispersed with a homomixer (produced by Tokushu Kika Kogyo K.K.) to obtain a liquid developer C. The volume average particle diameter of the toner measured by the use of the same device as in Example 1 was 1.7 μm.

<EXAMPLE 2>

In a Henschel mixer, 100 parts of a low molecular polyester resin (acid number: 0.5 mgKOH/g, Mn=3000, Mw=9000), 20 parts of carbon black (produced by Cabot Co. and marketed under trademark designation of "Mogul L"), and 5 parts of minute silica particles (produced by Japan Aerosil Ltd. and marketed under product code of "R-974") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer D. The volume average particle diameter of this liquid developer measured with the same device as in Example 1 was 1.8 μm.

<EXAMPLE 3>

In a Henschel mixer, 100 parts of a low molecular polyester resin (acid number: 35.2 mgKOH/g, Mn=2850, Mw=8700) and 20 parts of carbon black (produced by Cabot Co. and marketed under trademark designation of "Mogul L") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer E. The volume average particle diameter of this liquid developer measured with the same device as in Example 1 was 1.7 μm.

<EXAMPLE 4>

In a Henschel mixer, 100 parts of a low molecular polyester resin (acid number: 35.2 mgKOH/g, Mn=2650, Mw=8550), 20 parts of carbon black (produced by Cabot Co. and marketed under trademark designation of "Mogul L"), and 8 parts of minute silica particles (produced by Japan Aerosil Ltd. and marketed under product code of "R-974") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer F. The volume average particle diameter of this liquid developer measured with the same device as in Example 1 was 1.6 μm.

<CONTROL 3>

In a Henschel mixer, 100 parts of a low molecular polyester resin (acid number: 45.5 mgKOH/g, Mn=2800, Mw=9000), 20 parts of carbon black (produced by Cabot Co. and marketed under trademark designation of "Mogul L"), and 10 parts of minute silica particles (produced by Japan Aerosil Ltd. and marketed under product code of "R-974") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer G. The volume average particle diameter of this liquid developer measured with the same device as in Example 1 was 1.6 μm.

<EXAMPLE 5>

In a Henschel mixer, 100 parts of a low molecular polyester resin (acid number: 15.0 mgKOH/g, Mn=2700, Mw=8500) and 10 parts of C.I. Pigment Red 122 (produced by Dai-Nippon Ink & Chemicals, Inc. and marketed under trademark designation of "KET RED 310") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer H. The volume average particle diameter of this liquid developer measured with the same device as in Example 1 was 1.7 μm.

<EXAMPLE 6>

In a Henschel mixer, 100 parts of a low molecular polyester resin (acid number: 15.0 mgKOH/g, Mn=2700, Mw=8500) and 10 parts of C.I. Pigment Blue 15 (produced by Toyo Ink Mfg. Co., Ltd. and marketed under trademark designation of "LIONOL BLUE FG7350") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer I. The volume average particle diameter of this liquid developer measured with the same device as in Example 1 was 1.7 μm.

<EXAMPLE 7>

In a Henschel mixer, 100 parts of a low molecular polyester resin (acid number: 15.0 mgKOH/g, Mn=2700, Mw=8500) and 10 parts of C.I. Pigment Yellow 17 (produced by Toyo Ink Mfg. Co., Ltd. and marketed under trademark designation of "LIONOL YELLOW 4424") were thoroughly mixed. Then, the mixture was kneaded in a two-roll kneader at 180° C. for four hours. Subsequently, the resultant blend was thoroughly cooled and coarsely pulverized with a cutter mill to obtain coarse colored particles having an average particle diameter of about 100 μm.

The coarse colored particles were further processed by the same procedure as in Example 1 to produce a liquid developer J. The volume average particle diameter of this liquid developer measured with the same device as in Example 1 was 1.7 μm.

(Evaluation of physical properties of liquid developer)

By the use of a liquid developer evaluating device of FIG. 1, the liquid developers A~J mentioned above were each tested for the ratio of the surface potential, $V_0$, of the toner layer electrodeposited on the surface of the developer carrier mentioned above in the presence of bias application to the decrement of the potential, $\Delta V_{10}$, attenuating from the $V_0$ over a period of 10 seconds following the termination of the bias application ($V_0/\Delta V_{10}$).

Now, the method for evaluating the physical properties of the liquid developer will be described in detail below.

With reference to FIG. 1, an electrodeposited toner layer forming roller (30) has a diameter of 22 mm and is grounded. By interposing an electrodeposited toner layer forming part (g) in the form of a gap of 1 mm between the electrodeposited toner layer forming roller (30) and an electrodeposited toner layer forming electrode (31), setting an electrodeposited toner layer forming width (h) at 20 mm, setting the amount of the developer at 5 cc, rotating the electrodeposited toner layer forming roller (30) at a rate of 250 rpm, and applying a bias voltage of −300 V as an electrodeposition bias to the electrodeposited toner layer forming electrode (31) for one minute, an electrodeposited toner layer was formed on the electrodeposited toner layer forming roller (30). At this point of time, the greater part of toner particles in the developer existing between the electrodeposited toner layer forming roller (30) and an electrodeposited toner layer forming electrode (31) were electrodeposited on the electrodeposited toner layer forming roller (30). The surface potential of the toner layer electrodeposited on the electrodeposited toner layer forming roller (30) was measured in a surface potential measuring area (i) and recorded on a recorder. Then, the application of the electrodeposition bias was terminated with the rate of rotation of the electrodeposited toner layer forming roller (30) kept unchanged. Thus, the initial surface potential ($V_0$) of the electrodeposited toner layer on one minute's application of the electrodeposition bias and the decrement of the surface potential ($\Delta V_{10}$) over the period of 10 seconds after the bias application were determined and the ratio ($V_0/\Delta V_{10}$) was found by calculation. For the determination of the surface potential, a surface potential meter (33) produced by Trek Japan K.K. and marketed under product code of "Model 360" was used. A side view probe, "Model 6000B-4", was used as a probe for the surface potential meter. The results are shown in Table 1.

(Evaluation of developing property)

Figure 2:
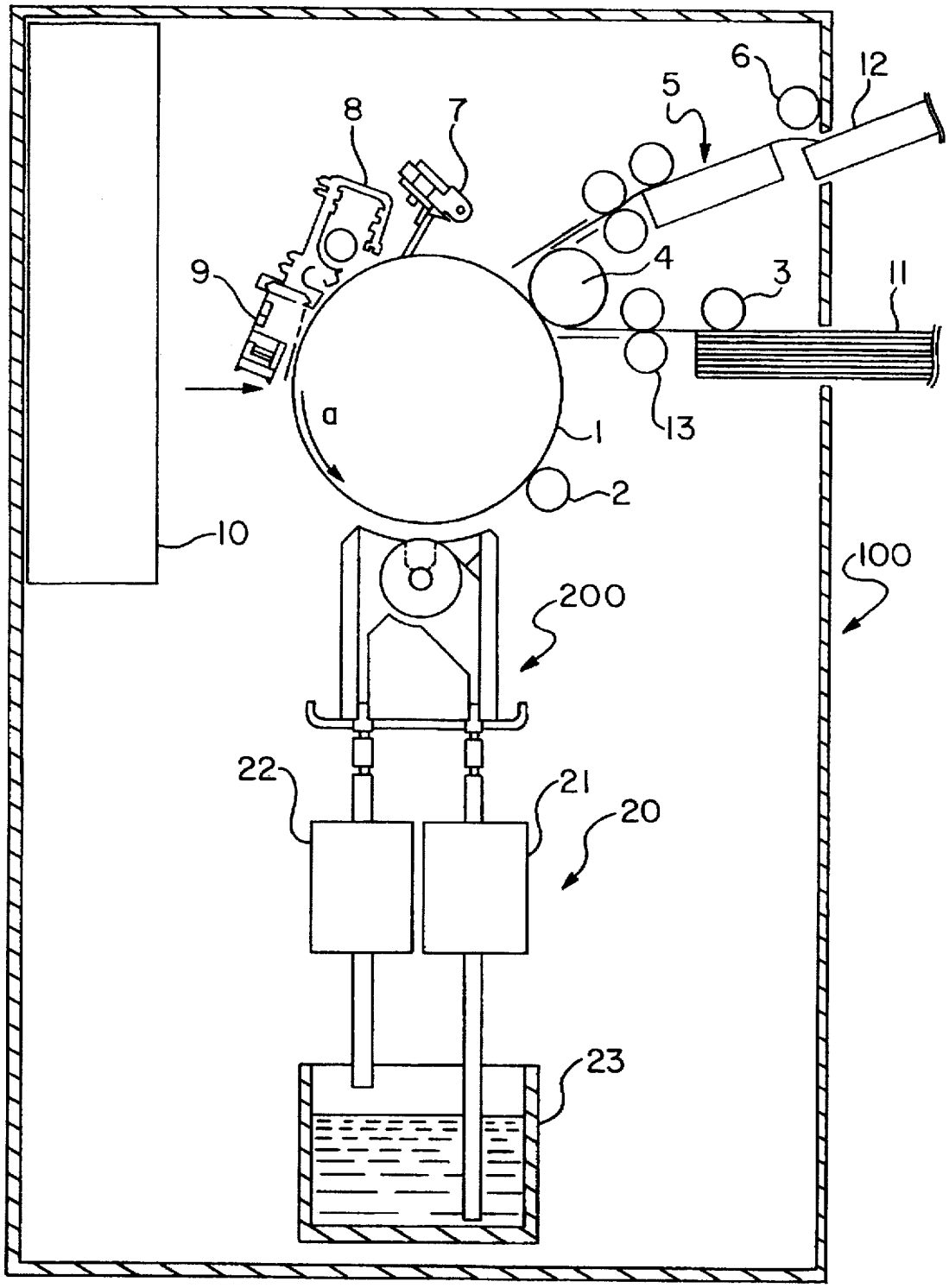
FIG. 2 is a sectional view schematically showing the construction of an electrophotographic printer designed for operation by the liquid developing method.

The liquid developers A~J mentioned above were each set in place in a liquid developing type electrophotographic printer (100) shown in FIG. 2 to print a solid image 3 cm×3 cm. During this printing operation, the image density (I.D.) as a function of the printing speed was determined and the developing property was rated by finding the largest value of the printing speed that produced an I.D. of not less than 1.2.

The image density was measured by the use of a McBeth reflection densitometer (produced by Konica K.K. and marketed under product code of "PDA-65"). The rating was made on a two-point scale, wherein "o" stands for a value of not less than 15 cm/s and "x" for a value less than 15 cm/s. With respect to the developers that contained color toners other than black, the largest printing speeds at which the amounts of the toners deposited equaled the amount of black toner deposited so much as to give an I.D. of 1.2 were determined.

Now, the liquid developing type electrophotographic printer (100) will be outlined below.

With reference to FIG. 2, the numeral (1) denotes a sensitive drum which rotates in the direction of an arrow (a). The surface of this sensitive drum (1) is charged to about +1000 V by the use of a scortron charging device (9). Then, an electrostatic latent image is written on the charged surface with a laser beam print head (10). The electrostatic latent image is converted into a sensible image by the use of a developing device (20). The rotating speed of the sensitive drum (1) is variable in the range of 5~50 cm/s as peripheral speed. Then, the developer adhering in an excess amount to the surface of the sensitive drum is removed with a squeeze roller (2) to give rise to a toner image containing a solvent slightly on the surface of the sensitive drum (1). To the squeeze roller (2), a voltage of −300 V similar in polarity to the toner is applied. The squeeze roller (2) is rotated counter to the direction of rotation of the sensitive drum (1). From a paper storage cassette (11), a paper is fed by a paper feeding roller (3) toward the interior of the printer. Then, the timing roller (13) causes the paper to be fed as synchronized with the toner image on the sensitive drum (1) into the transfer position across which the sensitive drum (1) and a transfer roller (4) are opposed to each other. The toner image is conveyed to the transfer position and electrostatically transferred onto the paper through the medium of the transfer roller (4). To the transfer roller (4), a potential of +1500 V is applied. The paper to which the toner image has been transferred is separated from the photosensitive drum (1), conveyed to a heater plate (5) for thermal fixture, enabled to have the image thermally fixed thereon, and discharged by a discharge roller (6) onto a discharged paper tray (12). The photosensitive drum (1) is deprived of the developer still remaining on the surface thereof by means of a cleaner (7) and further divested of electric charge remaining on the surface thereof by means of an eraser lamp (8). Thus, the series of printing operations is completed.

The developing device (20) is provided with a developer storage tank (23) for storing the liquid developer, a liquid supplying device (21) for scooping the liquid developer from within the developer storage tank (23), a developing head (200) opposed to the photosensitive drum (1) and adapted to develop the electrostatic latent image on the photosensitive drum (1) with the liquid developer supplied by the liquid supplying device (21), and a liquid recovering device (22) for returning the liquid developer from within the developing head (200) to the developer storage tank (23).

Figure 3:
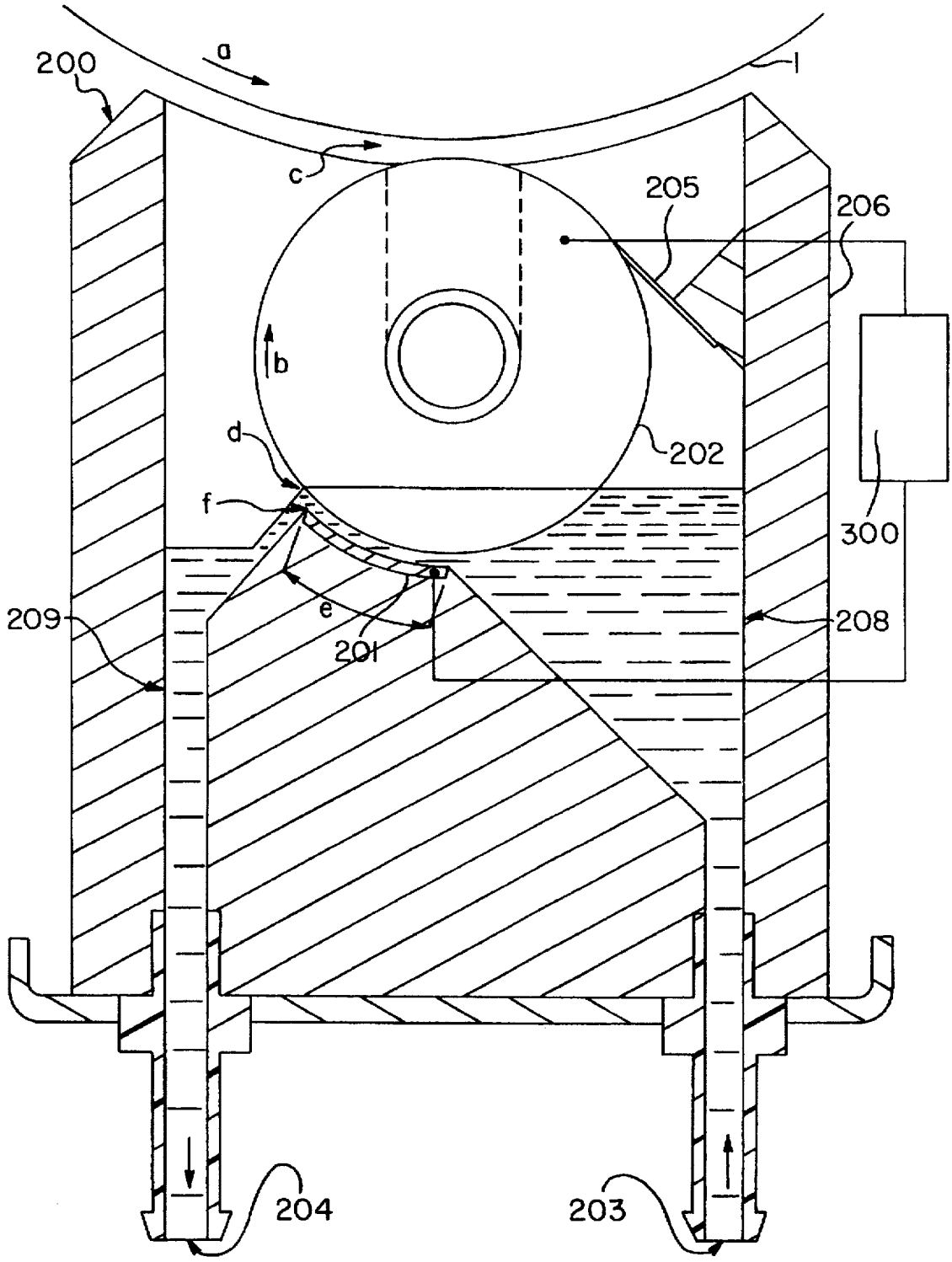
FIG. 3 is a sectional view schematically showing the construction of a liquid developing apparatus.

FIG. 3 is a magnified diagram of the neighborhood of the developing head (200). The developing head (200), as shown in FIG. 3, is provided with a developing roller (202) for having the liquid developer deposited on the surface thereof, a frame (206) for supporting the developing roller (202), a liquid storage tank (208) for storing the liquid developer, a developer tank (209) for recovering the liquid developer overflowing the developer tank (208), and a cleaning blade (205) for scraping off the liquid developer remaining on the developing roller (202). The liquid-expressing (dashed line) hatched part indicates the presence of the liquid developer.

Figure 4:
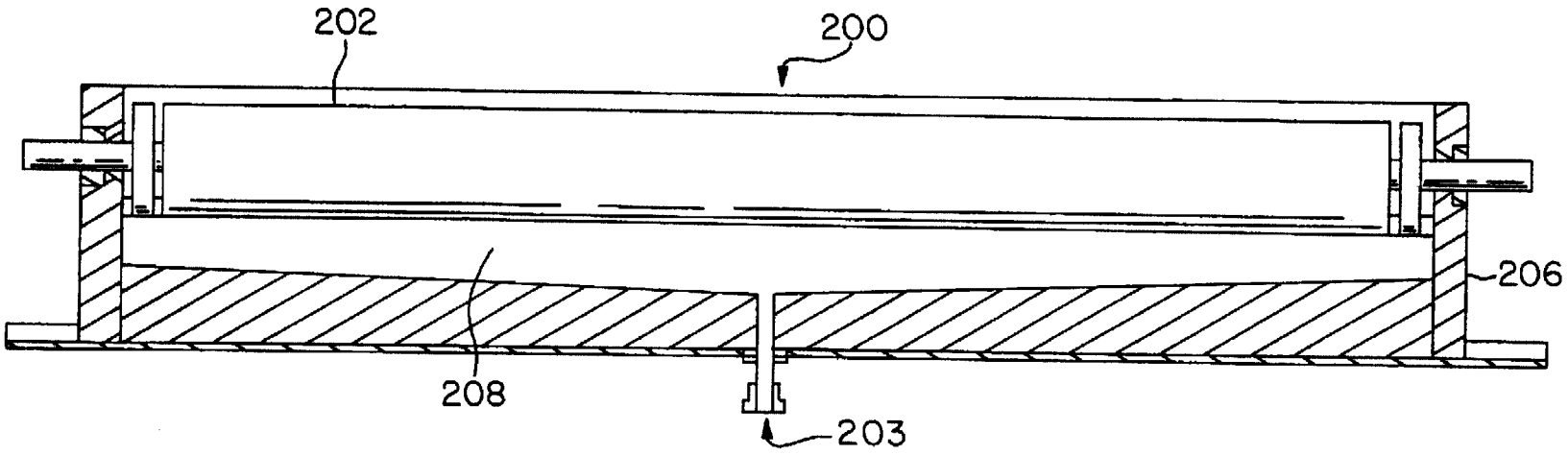
FIG. 4 is a sectional view showing the construction of the liquid developing apparatus as viewed in the longitudinal direction.

The developing roller (202) is disposed parallelly to the longitudinal direction of the sensitive drum (1) and supported by the frame (206) so as to be rotated in the direction of an arrow (b) shown in the diagram. The distance between the sensitive drum (1) and the developing roller (202) in their opposed parts (developing part) (c) is set at 200 μm. FIG. 4 shows the construction of the developing head (200) as viewed in the longitudinal direction.

The developer tank (208) is disposed below the developing roller (202). In the bottom of the developing tank (280), a liquid supplying aperture (203) connected to the liquid supplying device (21) shown in FIG. 2 is formed. During the process of development, the liquid developer is supplied through the liquid supply aperture (203) to the developer tank (208) and the lower part of the developing roller (202) is dipped in the liquid developer held in the developer tank (208).

Part of the upper end of the wall surface defining the developer tank (208) adjoins the lower part of the developing roller (202) and forms an edge part (f) extending parallelly to the longitudinal direction of the developing roller. After the developer tank (208) is filled to capacity with the liquid developer, the excess liquid developer overflows the edge part (f).

The inner wall surface of the developer tank (208) that extends from the edge part (f) to the part thereof opposed to the lowermost point of the developing roller (202) forms a circumferential surface (201) keeping a prescribed distance from the developing roller (202). This circumferential surface (201) serves as an electrode (201) (hereinafter referred to as "thin layer forming electrode") for depositing the toner on the surface of the developing roller (202) in consequence of the application of a voltage between itself and the developing roller (202).

By filling a gap (d) between the thin layer forming electrode (201) and the developing roller (202) (hereinafter referred to as the "thin layer forming part") with the liquid developer and then applying a voltage to the gap by means of a power source (300) connected to both the thin layer forming electrode (201) and the developing roller (202), the charged toner particles in the liquid developer are moved toward the developing roller (202) under the influence of the static force and, as a result, a thin layer of the toner (a thin layer of the liquid developer of a very high concentration) is formed on the surface of the developing roller (202) and a layer of carrier liquid from which the toner is virtually absent is formed on the thin layer of the toner. By setting the length of a thin layer forming part (d) (the range indicated by an arrow (e) in FIG. 3) at a level in the range of 3~80 mm, preferably in the range of 5~50 mm, it is made possible to lengthen amply the time spent in the movement of the toner required for the formation of the thin layer so that the liquid developer may form a thin layer of high concentration. By setting the distance between the thin layer forming electrode (201) and the developing roller (202) at a level in the range of 0.1~10 mm, preferably in the range of 0.3~3 mm, it is made possible to ensure perfect flow of the liquid developer to the thin layer forming part d and thereby attain the formation of the liquid developer layer composed of a thin layer of toner and a layer of medium liquid as mentioned above. In the electrophotographic printer used in the present experiment set the length of the thin layer forming part (d) at 25 mm and the distance between the thin layer forming electrode (201) and the developing roller (202) at 1 mm.

The liquid recovery tank (209) is disposed contiguously to the edge part (f) so that the liquid developer emanating from the developer tank (208) may overflow the edge part (f) and flow into the liquid recovery tank (209). At the bottom of the liquid recovery tank (209), a liquid recovery aperture (204) connected to the liquid recovery device (22) shown in FIG. 2 is formed. The liquid developer which has flowed into the liquid recovery tank (209) is recovered through the liquid recovery aperture (204) and returned to the developer storage tank (23) shown in FIG. 2.

The speed of rotation of the developing roller (202) is made variable. In the present experiment, it was so adjusted that the ratio of the peripheral speed of the developing roller (202) to that of the sensitive drum (1) (θ: speed of rotation of the developing roller/speed of rotation of the sensitive drum) would satisfy θ=1.

Now, the operation of the liquid developing device (20) will be described in detail below.

First, the liquid supplying device (21) is actuated to supply the liquid developer through the liquid supply aperture (203) to the developer tank (208). The liquid developer, after passing the thin layer forming part (d) and the liquid recovery tank (209), is recovered through the liquid recovery aperture (204) into the developer storage tank (23) by the liquid recovery device (22). It is then supplied again to the developing head (200) by the liquid supply device (21). During the process of development, therefore, the liquid developer is kept circulating in the developing device (20).

In the developing device (20), the ability of the liquid recovery device (22) to recover liquid is greater than that of the liquid supply device (21) to supply liquid. The level of the liquid developer in the developing head (200), therefore, is practically constant at its maximum height which slightly rises above the edge part (f) (namely the upper end of the electrode (201)) of the developer tank (208) as shown in FIG. 2.

Meanwhile, the developing roller (202) begins to rotate in the direction indicated by the arrow (b). Then, a voltage is applied between the electrode (201) and the developing roller (202). While the liquid developer is passing the thin layer forming part (d), the electrically charged toner particles in the liquid developer are moved under the influence of static power toward the developing roller (202), with the result that the toner deposits in the form of a thin layer on the surface of the developing roller (202) and the medium liquid from which the toner is virtually absent deposits in the form of a layer on the thin layer.

By the rotation of the developing roller (202), the liquid developer is forwarded to a developing part (c) and allowed to contact the surface of the sensitive drum (1). The developing roller (202) has a fixed developing bias applied thereto. The toner, when exposed to the Coulomb force originating in the electric field due to the electrostatic latent image on the sensitive drum (1), adheres to the latent image surface of the sensitive drum (1) and thereby implements the development of the electrostatic latent image.

The developer which remains thereafter on the developing roller (202) is scraped off by the cleaning blade (205).

| The conditions for the development are as follows. | |
|---|---|
| Voltage applied to the developing roller: | +300 V |
| Voltage applied to the thin layer forming electrode: | −1000 V |
| (Voltage applied to the thin layer forming part: | 1300 V) |
| Flow volume of liquid: | 200 cc/min |
| Length of developing area in longitudinal direction of the developing roller: | 320 mm |
| Surface potential of unexposed part of the sensitive material: | +750 V |

-continued

| The conditions for the development are as follows. | |
|---|---|
| Surface potential of exposed part of the sensitive material: | +50 V |
| Diameter of developing roller: | 30 mm |
| Surface coarseness of developing roller: (ten points average roughness) | 2 μm |

The results of the experiment are shown in Table 1.

TABLE 1

| | Liquid developer | $V_0/\Delta V_{10}$ | Maximum value of print speed satisfying I.D. ≧ 1.2 (cm/sec) | Rating of d.p.* |
|---|---|---|---|---|
| Example 1 | A | 3.2 | 35.5 | ○ |
| Example 2 | D | 1.7 | 20.5 | ○ |
| Example 3 | E | 17.5 | 45.0 | ○ |
| Example 4 | F | 3.3 | 36.5 | ○ |
| Example 5 | G | 3.1 | 34.0 | ○ |
| Example 6 | H | 3.5 | 37.0 | ○ |
| Example 7 | J | 23.5 | 49.5 | ○ |
| Control 1 | B | 1.1 | 8.0 | X |
| Control 2 | C | 1.3 | 9.0 | X |
| Control 3 | I | 27.5 | 10.5 | X |

*d.p. = Developing property

Although the present invention has been fully described by way of examples with reference to the accompanying drawings, it is to be noted that various changes and modifications will be apparent to those skilled in the art.

Therefore, unless otherwise such changes and modifications depart form the scope of the present invention, they should be constructed as being included therein.

What is claimed is:

1. A liquid developer for developing an electrostatic latent image comprising a carrier fluid and electrically charged toner particles dispersed therein, wherein said liquid developer satisfies the following relationship:

$$25.0 \geqq V_0/\Delta V_{10} \geqq 1.5$$

wherein $V_0$ denotes surface potential of a toner particle layer electrically deposited on a conductive substrate by applying bias voltage between said substrate and an electrode confronting said substrate, and $\Delta V_{10}$ denotes change of the surface potential decaying for 10 seconds after shutting off the bias voltage.

2. The liquid developer as claimed in claim 1 which further satisfies the following relationship:

$$20.0 \geqq V_0/\Delta V_{10} \geqq 1.5$$

3. The liquid developer as claimed in claim 1 which has a volume resistivity of not less than $10^{10}$ Ω·cm.

4. The liquid developer as claimed in claim 1 wherein said carrier fluid has a volume resistivity of $10^{10}$ to $10^{14}$ Ω·cm.

5. The liquid developer as claimed in claim 1 wherein said toner particles have a volume average particle size of 0.5 to 5.0 μm.

6. The liquid developer as claimed in claim 1 wherein said toner particles are contained in an amount of 1 to 90 percent by weight relative to the developer.

7. The liquid developer as claimed in claim 1 wherein said toner particles comprise a colorant and a binder resin which has an acid number of 0.5 to 100 mg KOH/g.

8. The liquid developer as claimed in claim 7 which further comprises a dispersion resin dissolved in said carrier fluid.

9. The liquid developer as claimed in claim 8 wherein said dispersion resin is contained in an amount of 1 to 10 percent by weight relative to that of the toner particles.

10. The liquid developer as claimed in claim 8 wherein said dispersion resin contains a nitrogen atom.

11. The liquid developer as claimed in claim 7 which further comprises a charge controlling agent.

12. The liquid developer as claimed in claim 1 wherein said toner particles comprise a colorant and a binder resin which contains at least one compound selected from the group consisting of organic acid, higher fatty acid, inorganic oxide fine particle, and resin acid.

13. The liquid developer as claimed in claim 1 wherein said toner particles comprise a colorant, a binder resin, and inorganic fine particles fixed on the surface thereof.

14. A developing device comprising:

(a) a conductive member which carries a liquid developer on the surface thereof and contacts the developer to an electrostatic latent image carrying member;

(b) an electrode which confronts said conductive member;

(c) a developer supplier which supplies a liquid developer to a confrontation area between said conductive member and said electrode, wherein said liquid developer comprises a carrier fluid and electrically charged toner particles dispersed therein, and satisfies the following relationship:

$$25.0 \geqq V_0/\Delta V_{10} \geqq 1.5$$

wherein $V_0$ denotes surface potential of a toner particle layer electrically deposited on said conductive member by applying bias voltage between said conductive member and said electrode, and $\Delta V_{10}$ denotes change of the surface potential decaying for 10 seconds after shutting off the bias voltage; and (d) an electric power source which applies bias voltage between said conductive member and said electrode so as to deposit toner particles contained in a liquid developer on the conductive member.

15. The developing device as claimed in claim 14 wherein said confrontation area is 3 to 80 mm long.

16. A method for developing an electrostatic latent image comprising steps of:

(a) providing a liquid developer to confrontation between a conductive member and an electrode, wherein said liquid developer comprises a carrier fluid and electrically charged toner particles dispersed therein;

(b) applying bias voltage between said conductive member and said electrode so as to deposit toner particles contained in the developer on the conductive member, wherein said liquid developer satisfies the following relationship:

$$25.0 \geqq V_0/\Delta V_{10} \geqq 1.5$$

wherein $V_0$ denotes surface potential of a toner particle layer electrically deposited on said conductive member and $\Delta V_{10}$ denotes change of the surface potential decaying for 10 seconds after shutting off the bias voltage; and (c) contacting the developer existing on the conductive member to an electrostatic latent image after applying bias voltage.

* * * * *